United States Patent [19]

Burns

[11] Patent Number: 4,706,594

[45] Date of Patent: Nov. 17, 1987

[54] BOAT MOORING LINE GUIDE AND HOLDER

[76] Inventor: Joel Burns, 801 NW. 12 Ave., Dania, Fla. 33004

[21] Appl. No.: 859,020

[22] Filed: May 2, 1986

[51] Int. Cl.[4] ..... B63B 21/04

[52] U.S. Cl. ..... 114/230; 114/218; 24/130

[58] Field of Search ..... 114/218, 230, 266, 267, 114/199, 200, 231, 343, 362, 381, 249; 441/3; 24/230.5 TP, 128, 130

[56] References Cited

U.S. PATENT DOCUMENTS

| | | | |
|---|---|---|---|
| 1,770,967 | 7/1930 | Bean | 114/218 |
| 3,110,046 | 11/1963 | Fischer | 114/230 |
| 3,126,858 | 3/1964 | Rusinski | 114/218 |
| 3,473,505 | 10/1969 | Brown | 114/218 |
| 3,507,243 | 4/1970 | Brown | 114/218 |
| 4,028,054 | 4/1978 | Bruner | 114/230 |
| 4,114,553 | 9/1978 | Zidek | 114/230 |
| 4,173,194 | 11/1979 | McLaughlin | 114/230 |

*Primary Examiner*—Joseph F. Peters, Jr.
*Assistant Examiner*—Clifford T. Bartz
*Attorney, Agent, or Firm*—Alvin S. Blum

[57] ABSTRACT

A line guiding and securing system for guiding a line thrown from a boat down into a securing device fastened to a piling or seawall. Device has a pair of arms that reach upwardly and outwardly to form a V shape that guides the line to a central channel. System operates with a line throwing ball attached to the end of the line. The ball catches in the central channel for securing the boat and must be lifted vertically to release.

20 Claims, 9 Drawing Figures

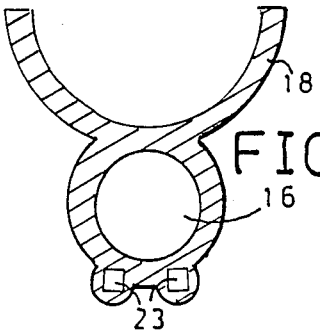
FIG. 6
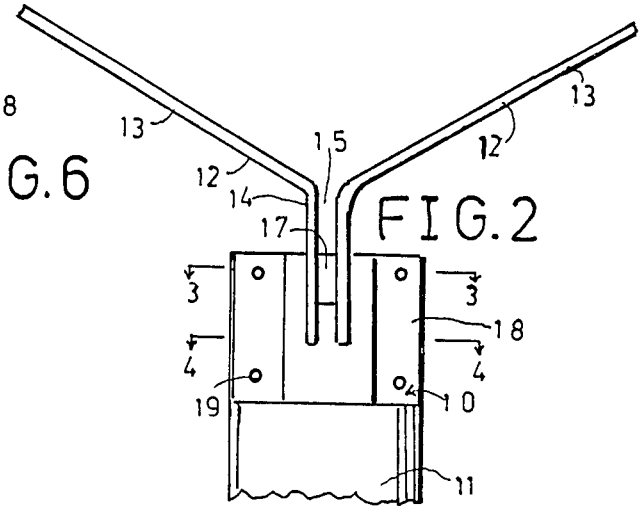
FIG. 2
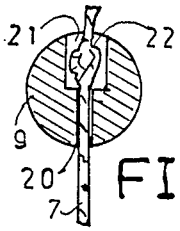
FIG. 9
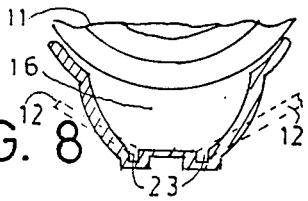
FIG. 8
FIG. 5
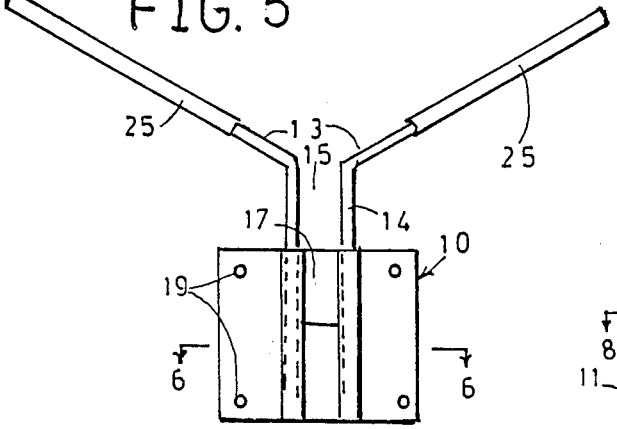
FIG. 7
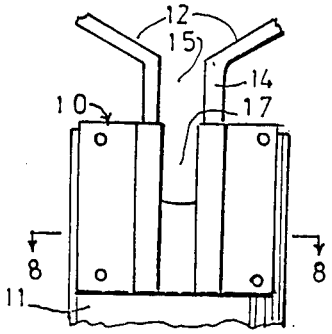

BOAT MOORING LINE GUIDE AND HOLDER

BACKGROUND OF THE INVENTION

This invention is related to mooring devices and more particularly to apparatus for facilitating the securing of boats to fixed objects such as piers, pilings, seawalls and the like with lines.

Search of the patent literature revealed U.S. Pat. Nos. 3,473,505 and 3,110,046. U.S. Pat. No. 3,473,505 discloses a special cleat arranged to catch and securely hold a line having a holder attached thereto. The cleat base fastens to horizontal surfaces. Extending vertically from the base are a pair of upper arms that engage the holder. These arms extend downwardly in an inverted-U-shape to prevent the holder from disengaging when lifted upward.

When a boat approaches a pier or other object to which the operator wishes to make his vessel fast with lines, he must first manage to fasten a line from the vessel to a piling, cleat or other securing means. Ordinarily, someone on shore catches a line thrown from the vessel and secures it to a securing device. In the absence of such assistance, securing the vessel may be difficult, especially under adverse wind and current conditions or absent experienced crew. The cleat of the above cited patent is directed to the assistance of the boatmen in securing the vessel. It provides a holder on the throw line and a row of cleats to engage the holder so that the thrower has an easier target than a single cleat. The row of cleats described is an expensive structure, limited to horizontal surfaces.

SUMMARY OF THE INVENTION

It is an object of the invention to provide a device that may be fastened to a vertical surface such as a piling or seawall to catch a thrown line and hold it fast. It is a further object to catch a line that is thrown without great accuracy and to guide said line into a line-securing position without extensive manipulation. It is another object to hold said line with a holder that has no moving parts. It is a further object to provide a line catching and holding device that can catch and hold more than one line. It is a further object to provide line-end throwing means to facilitate line throwing. It is a further object to provide line-end grasping means to grasp said line and prevent it from sliding through line holding means. It is yet another object to provide a pair of line guiding arms extending upwardly and outwardly from line holding means to catch a thrown line and guide said line toward a central line-holding channel as the line falls.

These and other objects and advantages of the invention will become evident from the following detailed description.

BRIEF DESCRIPTION OF THE DRAWINGS

FIG. 2 is a front elevation of the holder of the invention.

FIG. 5 is a front elevation of another embodiment of the invention.

FIG. 6 is a cross-sectional view through line 6—6 of FIG. 5.

FIG. 7 is a front elevation of another embodiment of the invention.

FIG. 8 is a cross-sectional view through line 8—8 of FIG. 7.

FIG. 9 is a cross-sectional view of the line throwing ball of the invention with line attached.

DETAILED DESCRIPTION OF THE PREFERRED EMBODIMENT

Figures 1, 3, 4:
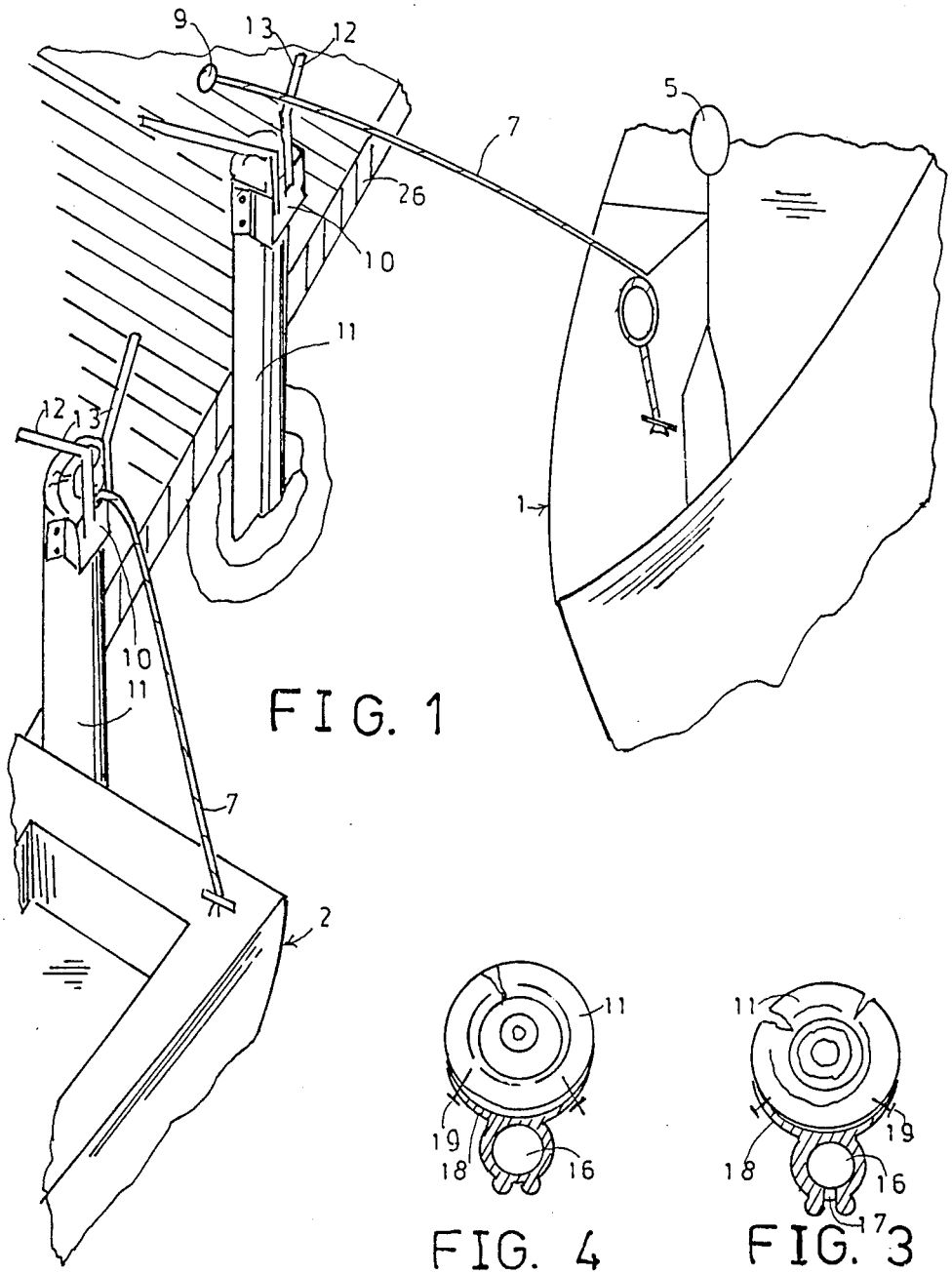
FIG. 1 is a perspective view of the invention in use with two boats partially shown.
FIG. 3 is a cross-sectional view through line 3—3 of FIG. 2.
FIG. 4 is a cross-sectional view through line 4—4 of FIG. 2.

Referring first to the views of the device in FIGS. 2, 3, 4 and the illustration of the devices in use in FIG. 1, crewman 5 on boat 1 throws line ball 9 attached to line 7 above and beyond mooring line guide and holder 10 attached to piling 11. As the ball falls, it will strike arm 12 on its upper, outwardly sloping portion 13. By reaching outwardly, the pair of arms 12 greatly increases the target region that the crewman must reach with the ball 9 in order to secure the boat by line 7 to holder 10, thereby reducing the skill required. The slope of the upper portion 13 of arms 12 causes the line to move centrally as it falls, dropping into the space 15 between the vertical, parallel lower portions 14 of arms 12. This space 15 is narrower than the diameter of ball 9, but wider than line 7, permitting the line to pass through, but preventing the ball from passing through. Directly behind the lower portion 14 of the arms 12 is vertical channel 16, of shape and dimension sufficient to admit line ball 9. The channel 16 is open at its upper front surface at slot 17 which is coextensive with space 15, thereby permitting line 7 to pass through slot 17 to the boat when ball 9 has dropped into channel 16. This secures the boat to holder 10 when the crewman takes up the slack in line 7. Boat 2 is shown made fast to pier 26 in this manner. The channel 16 can accommodate at least two balls 9 and lines 7.

Base plate 18 supports channel 16, which in turn supports arms 12. Base plate 18 may be secured to piling 11 by bolts 19 or by other means well known in the art such as straps, U-bolts and the like. The device 10 may be applied effectively to other vertical surfaces such as seawalls. To disengage the line ball 9 from the channel 16, the line 7 is simply lifted vertically from channel 16 and above the parallel portion of the arms 12, permitting passage of the ball 9 and the line 7 to the boat.

The device 10 may be constructed of anodized aluminum, galvanized steel, plastic or other strong and corrosion resistant material. The ball may be of plastic or metal construction. A heavy end knot such as a turk's head knot may be substituted for the ball. The hole 20 in the ball 9 has an expanded portion 21 to retain knot 22 tied in line 7 to prevent line 7 from sliding through hole 20 when tension is applied.

An alternative embodiment, shown in FIG. 5 in front elevation and FIG. 6 in cross section through line 6—6 of FIG. 5 illustrates use of profile extrusion to fabricate the invention. The profile seen in FIG. 6 is extruded of aluminum or plastic. The slot 17 is cut in the upper, anterior wall of channel 16. Bolt holes 24 are drilled. Arms 12 are then inserted into arm holes 23. Arm holes 23 and arms 12 are preferably non-circular in cross-section to resist rotation of arm 12 in hole 23. Arms 12 may be held securely in holes 23 by means well known in the prior art such as bolting, welding and adhesives. The arms 12 are shown with a solid lower portion and a tubular sleeve upper portion 25 that slides onto the lower portion. This alternate arm structure may be advantageous to reduce packing and shipping costs, with the sleeves attached at installation.

FIGS. 7 and 8 show an embodiment of the invention formed from sheet material. Recesses 23 are provided for attachment of arm 12 shown in phantom in FIG. 8. The channel 16 lacks a rear wall, which is provided by the vertical surface to which the device 10 is secured such as the piling 11.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A mooring line guiding and holding system for securing a water craft to a fixed vertical object with at least one line terminating in a throwing ball means of greater diameter than said line, comprising: vertical attaching means for attaching said system to said fixed vertical object; vertical channel means attached at its posterior portion to said vertical attaching means, said vertical channel means having an open top for receiving said throwing ball means through said open top; said channel means further including ball retaining means for retaining said ball means, guiding arms attached to the anterior portion of said channel means, said arms in a first, lower portion extending vertically upward from said channel means substantially parallel to one another and spaced apart in a central space a distance sufficiently great to pass said line but insufficient to pass said ball means, said arms in a second, upper portion extending upward from said lower portion at an angle from the vertical of greater than ten degrees and less than eighty degrees, wherein the pair of upper portions of arms form a V-shape lying substantially in a plane intersecting the path of a line thrown from said water craft to said fixed object, said arms adapted for guiding said line down from any lateral position at which it strikes said arms and centrally to said central space as it falls and adapted for guiding said throwing ball means at the end of said line into the top of said channel means; said anterior portion of said channel means having slot means coextensive with said central space and extending downward from said open top a distance greater than the radius of said ball means, said slot means adapted for passing said line from said channel means to said water craft and for retaining said ball within said channel means when tension is applied to said line by a secured water craft, said channel means having a substantially vertical longitudinal axis for releasing said ball means when said line is lifted vertically.

2. The invention of claim 1 including throwing ball means substantially spherical in shape and having a diametral hole therethrough, said hole having a first portion of a diameter large enough to pass said line but not large enough to pass a knot in said line and a second portion large enough to pass said knot, said ball means adapted for securing to the end of said line to be thrown over said arms and to lodge in said channel means for securing said water craft.

3. The invention of claim 1 wherein said channel means is substantially cylindrical in shape.

4. The invention of claim 1 including a pair of arm holding apertures formed in the anterior portion of said channel means, said apertures adapted for holding said arms.

5. The invention of claim 4, wherein said apertures and said arms are non-circular in cross section to prevent rotation of said arms when installed in said apertures.

6. The invention of claim 5 including formation of said attaching means, said channel means and said apertures in a combined profile extrusion.

7. The invention of claim 6 wherein said extrusion is composed of an aluminum alloy.

8. The invention of claim 6, wherein said extrusion is composed of a plastic material.

9. The invention of claim 1, wherein said upper portion of said arm is comprised of a fixed lower portion and an attachable upper portion for packaging and shipping in a more convenient disassembled form.

10. The invention of claim 1, wherein said fixed object is a piling.

11. The invention of claim 1, wherein said fixed object is a seawall.

12. The invention of claim 1, wherein said channel means and said vertical attaching means are formed from a single folded sheet.

13. The invention of claim 10, wherein said vertical attaching means has a surface for attaching to said piling that has the shape of a portion of a cylinder for more effective attachment.

14. A mooring line guiding and holding system for securing a watercraft to a fixed vertical surface such as a piling or seawall with a throw line terminating in an enlarged head, comprising:

(a) head engaging and retaining vertical channel means, said channel means having a substantially vertical longitudinal axis and including an opening at its upper end for receiving said head, and vertical walls for retaining said head;

(b) vertical slot means at the anterior of said channel means with an opening at its upper end for receiving said line and with a closure at its lower end for retaining said line, said slot means having a width great enough to freely pass said line and too narrow to permit passage of said head, said slot means providing a passage coextensive with the space within said channel means;

(c) vertical surface attaching means connected to the posterior portion of said channel means for attaching said system to said vertical surface;

(d) a pair of line guiding arms attached to the anterior portion of said channel means, said arms in a first, lower portion extending vertically upward from said channel means substantially parallel to one another and spaced apart in a central space a distance sufficiently great to pass said line but insufficient to pass said head, said arms in a second, upper portion extending upward from said lower portion at an angle from the vertical of greater than ten degrees and less than eighty degrees, wherein the pair of upper portions of arms form a V-shape lying substantially in a plane intersecting the path of a line thrown from said water craft to said fixed object, said arms adapted for guiding said line down from any lateral position at which it strikes said arms and centrally to said central space as it falls and for guiding said head at the end of said line into the top of said channel means.

15. The invention of claim 14 including a pair of arm holding apertures formed in the anterior portion of said channel means, said apertures adapted for holding said arms.

16. The invention of claim 15, wherein said apertures and said arms are non-circular in cross section to prevent rotation of said arms when installed in said apertures.

17. The invention of claim 16 including formation of said attaching means, said channel means and said apertures in a combined profile extrusion of aluminum alloy.

18. The invention of claim 16 including the formation of said attaching means, said channel means and said apertures in a combined profile extrusion of a plastic material.

19. The invention of claim 14, wherein said upper portion of said arm is comprised of a fixed lower portion and an attachable upper portion for packaging and shipping in a more convenient disassembled form.

20. The invention of claim 14, wherein said channel means and said attaching plate means are formed from a single folded sheet.

* * * * *